United States Patent [19]

Meistrell

[11] Patent Number: 4,862,517

[45] Date of Patent: Sep. 5, 1989

[54] OFFSET ZIPPER CLOSED WET SUIT

[75] Inventor: William R. Meistrell, Manhattan Beach, Calif.

[73] Assignee: Dive N'Surf, Inc., Hermosa Beach, Calif.

[21] Appl. No.: 229,974

[22] Filed: Aug. 9, 1988

[51] Int. Cl.[4] ..... B63C 11/04

[52] U.S. Cl. ..... 2/2.1 R; 2/79

[58] Field of Search ..... 2/2.1 R, 69.5, 79, 2, 2/2.1 A

[56] References Cited

U.S. PATENT DOCUMENTS

| | | | |
|---|---|---|---|
| D. 202,976 | 11/1965 | O'Neill | D3/17 |
| 1,706,097 | 2/1927 | Aud . | |
| 2,582,811 | 1/1952 | Williams | 2/2.1 |
| 2,663,873 | 12/1953 | Stern | 2/79 |
| 3,493,972 | 12/1967 | Oldham | 2/2.1 R |
| 3,643,264 | 2/1972 | Rector | 2/2.1 R |
| 3,763,498 | 10/1973 | Rector | 2/2.1 R |
| 3,956,774 | 5/1976 | Spaulding | 2/79 |
| 4,062,079 | 12/1977 | Potter | 2/2.1 R |
| 4,242,769 | 1/1981 | Rayfield et al. | 2/79 R |
| 4,464,795 | 8/1984 | Long et al. | 2/2.1 R |
| 4,547,904 | 10/1985 | Long et al. | 2/2.1 R |
| 4,773,100 | 9/1988 | Kuo | 2/79 R |

FOREIGN PATENT DOCUMENTS

| | | | |
|---|---|---|---|
| 1252280 | 12/1960 | France | 2/2.1 R |
| 1473129 | 2/1967 | France | 2/2.1 R |
| 318165 | 6/1934 | Italy | 2/79 |
| 341321 | 6/1936 | Italy | 2/79 |
| 471550 | 6/1969 | Switzerland | 2/79 |
| 0759396 | 3/1980 | U.S.S.R. | 2/2.1 R |
| 1546202 | 5/1979 | United Kingdom | 2/2.1 R |

OTHER PUBLICATIONS

Publication-German-Document #2929317, Date: Feb. 1981 Country: Germany, Name: Littler B.

*Primary Examiner*—Werner H. Schroeder
*Assistant Examiner*—Jeanette E. Chapman
*Attorney, Agent, or Firm*—William W. Haefliger

[57] ABSTRACT

In a wet suit having a lower trunk portion, leg portions integral with the lower trunk portion, upper trunk and neck portions, and first and second arm portions integral with the upper trunk and neck portions, the improvement comprising:

(a) the upper trunk and neck portions including a first section integral with the first arm portion and a second section integral with the second arm portion, the said sections defining a split that extends therebetween, downwardly and sidewardly, to terminate at a locus in sidewardly offset relation to the center of the lower trunk portion, (b) and connector structure on the sections to interconnect them along the length of the split.

The leg and neck portions of the suit may be omitted.

2 Claims, 2 Drawing Sheets

FIG. 2.
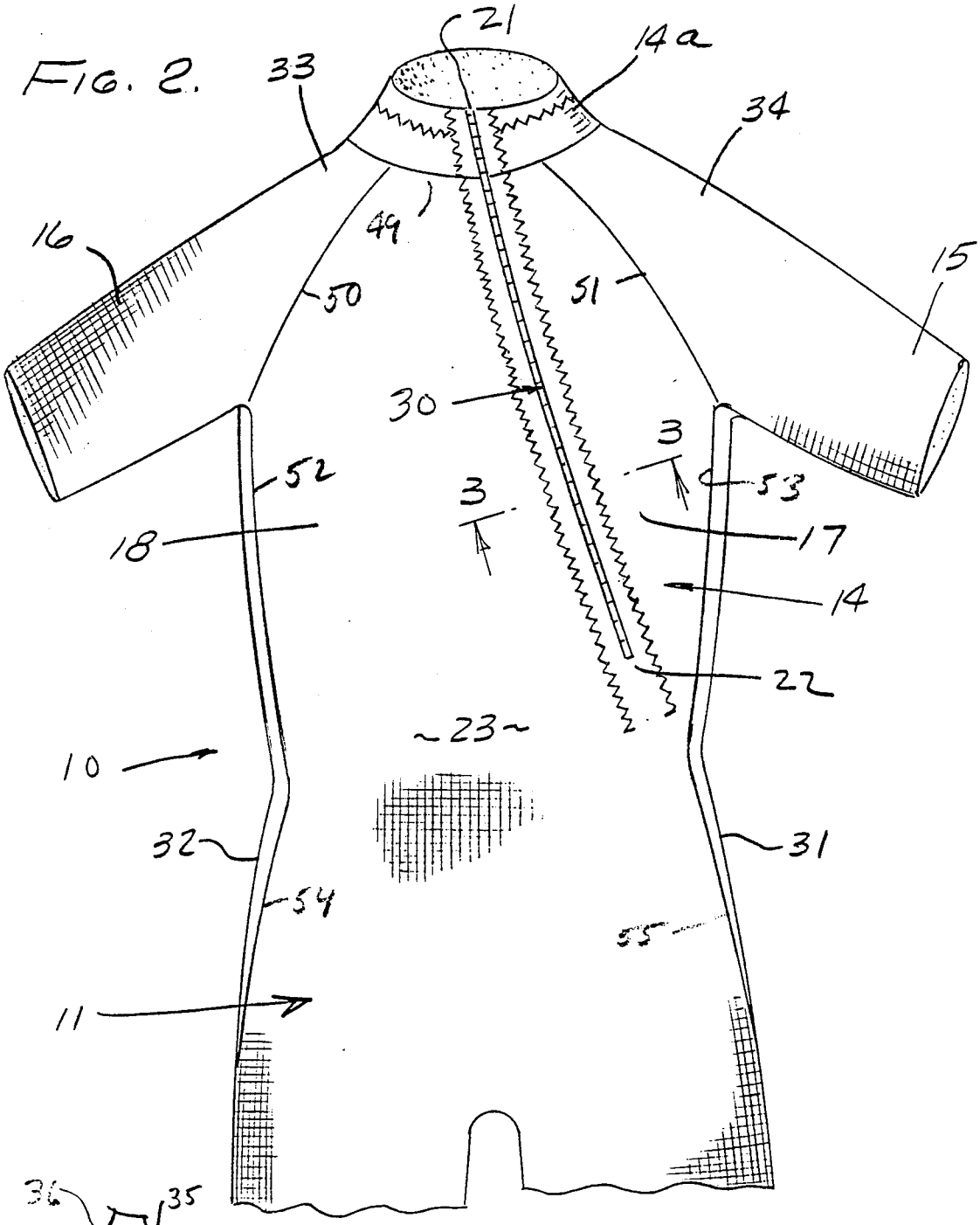
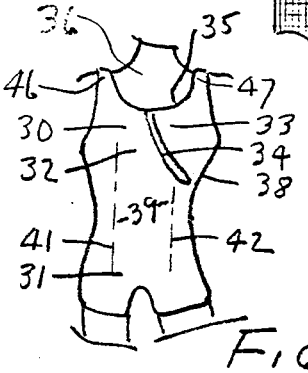
FIG 4
FIG. 3.
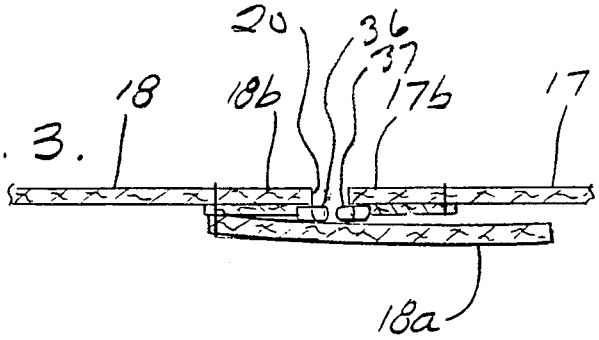

OFFSET ZIPPER CLOSED WET SUIT

BACKGROUND OF THE INVENTION

This invention relates generally to wet suits as used by surfers, boardsailers, divers and swimmers and other aquatic sports; and more particularly it concerns such a suit the lower middle trunk of which is free of constraint as is normally imposed by a zipper or other connector.

Contemporary wet suits are constructed to have a vertical zipper at the suit back, to enable the wearer to easily step into or out of the suit when the zipper is down, i.e. unzipped; however, such zippers are not stretchable, and they impose undesired constraint when the wearer tries to bend over, forwardly, thus, the stretchable feature of such suits, particularly adjacent the back of the wearer is defeated during such bending. There is need for a wet suit which overcomes this problem or difficulty, and which enables the wearer to freely move and bend, in all directions and which is of simple, unitary construction.

SUMMARY OF THE INVENTION

It is a major object of the invention to provide an improved wet suit, which meets the above need, and is of simple, unitary construction. Basically, the wet suit of the invention has a lower trunk portion, leg portions integral with the lower trunk portion, upper trunk and neck portions, and first and second arm portions integral with the upper trunk and neck portions; further it lies in constructing the suit so that:

(a) the upper trunk and neck portions include a first section integral with the first arm portion and a second section integral with the second arm portion, the said sections defining a split that extends therebetween, downwardly and sidewardly, to terminate at a locus in sidewardly offset relation to the center of the lower trunk portion, (b) and means on said sections to interconnect them along the length of the split.

As will appear, the sections and split are typically at the rear of the suit so that the split termination locus is at the rear of the suit offset sidewardly from the wearer's spine region; and that locus is near one of the left and right sides of the suit, at the suit waist region, and the user is free to bend in all directions without restraint imposed by a zipper even though a zipper is typically used. The trunk portions typically consist of stretchable insulative material, such as Neoprene elastomer foam.

In putting on the wet suit, the user separates the two sections and steps into the suit at its top; he then lifts the latter over his shoulders and he inserts his arms through the arm portions. He then zips up or closes the offset split, from bottom to top at the neck opening. All of these structures, except the zipper, are stretchable, so that the task o entering and leaving the suit is minimized, and a very good protective fit of the suit to the wearer is achieved.

These and other objects and advantages of the invention, as well as the details of an illustrative embodiment, will be more fully understood from the following specification and drawings, in which:

DRAWING DESCRIPTION

FIG. 2 is a rear elevation showing the neck and panel sections closed together along the diagonal split;

FIG. 3 is an enlarged fragmentary section showing zipper construction details; and FIG. 4 is a rear elevation showing a modified suit.

DETAILED DESCRIPTION

Figure 1:
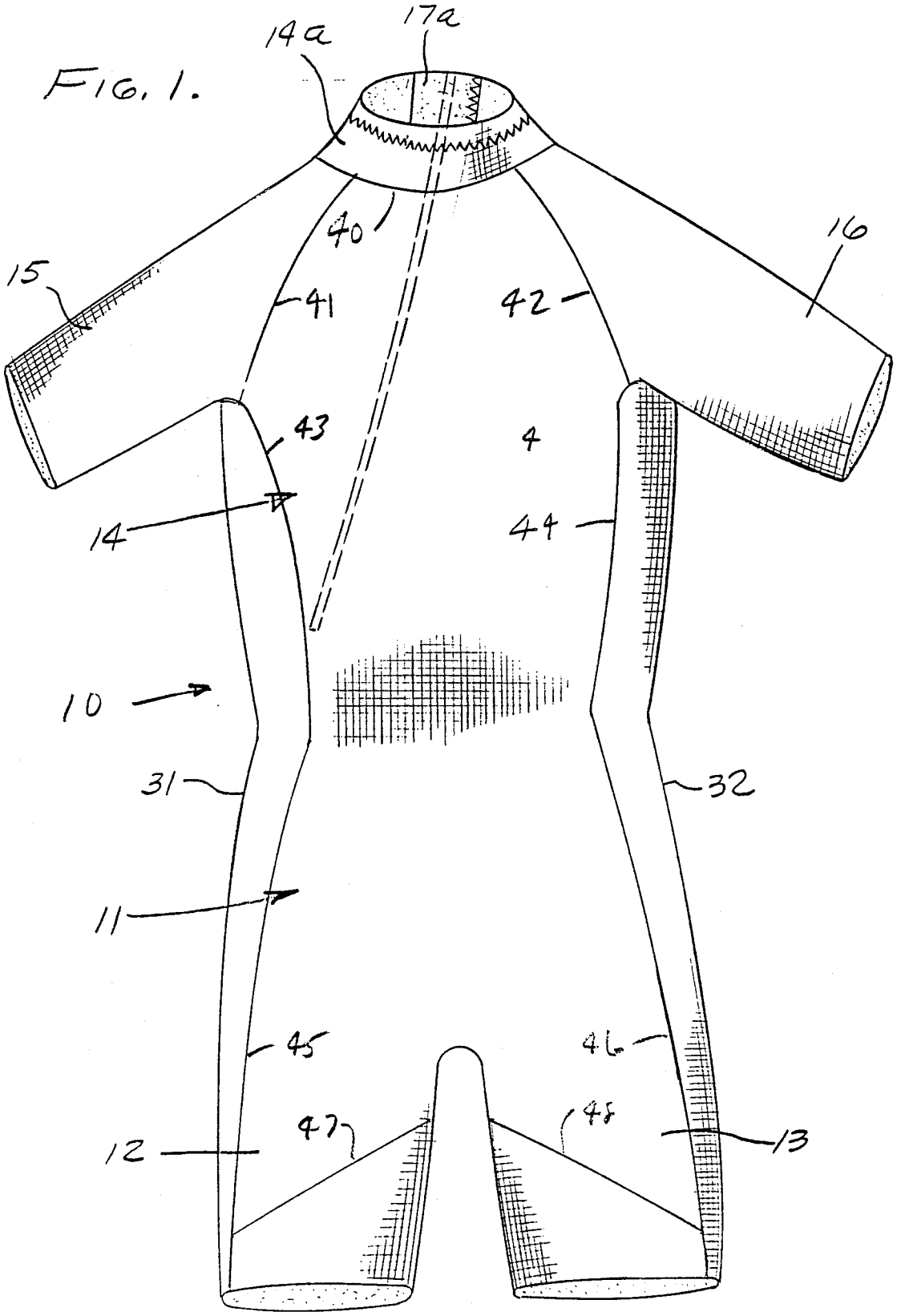
FIG. 1 is a front elevation showing a wet suit incorporating the invention.

In the drawings, the wet suit 10 has a close fitting lower trunk portion 11, leg portions 12 and 13 integral with the lower trunk portion and protruding downwardly to grip the user's legs, and upper trunk portion 14 and neck portion **14*a*, and first and second arm gripping arm portions 15 and 16** integral with the upper trunk portion. The wet suit typically consists of flexible, heat insulative material such as elastomer foam, one example being Neoprene foam, in stretchable sheet form. Other usable materials are stretchable LYCRA SPANDEX, and other stretchable, close fitting sheets.

The upper trunk portion 14, in accordance with the invention, includes at the suit rear side, seen in FIG. 2, a first section, as at 17 integral with the first arm portion, and a second section, as at 18, integral with the second arm portion 16. The sections define a split 20 that extends therebetween, downwardly and sidewardly, i.e. diagonally along the split main extent, relative to the suit vertical extent, from locus 21 at the top of the neck, to locus 22 at the bottom of the split. locus 22 is sidewardly offset relative to the central region 23 of the trunk lower portion so that the latter, adjacent the spine of the wearer is continuous and stretchable along the spine central and lower regions. Thus, when the split is closed, the split closing means (non-stretchable) does not inhibit bending of the spine as during underwater aquatic maneuvering of the wearer. Region 23 is everywhere spaced from the split, and is below sections 17 and 18.

Means is provided to close the split, and may advantageously take the form of the zipper structure seen at 30 in FIGS. 2 and 3. The zipper extends between the two loci 21 and 22, at the split, to close together the panel sections 17 and 18. Locus 22 is proximate one of the sides of the suit (see left and right sides 31 and 32), and is preferably proximate the suit waist region, as shown.

The sections 17 and 18 are relatively separable when the zipper is unzipped, to provide access to space enabling user body entry relatively downwardly into the wet suit. Thus, for example, the section 17 is moved to the right relative to the section 18; the user steps into the leg portions and pulls shoulder portions 33 and 34 over his shoulders and extends his arms through 15 and 16; and he then zips up the zipper, which travels diagonally.

It will be noted that the neck portion **14*a* is stretchable to allow entry and passage of the user's head. Also, the lower trunk portion is annularly continuous about the body of the wearer, below locus 22 which allows stretching in all directions, including vertically at the back, allowing free forward bending of the wearer. Overlap of the sections 17 and 18 as seen in FIG. 3** effects sealing off and tight fits, to minimize body heat loss from the interior of the suit to the exterior.

The section 18 has a lower flap extension **18*a* fitting under section 17 next to the zipper. See zipper sections 36 and 37 between flap extension 18*a* and the sections 17 and 18 upper flap extents 17*b* and 18*b*, in FIG. 3**.

Note also seams 40–55 interconnecting suit panels, as shown.

FIG. 4 shows a modified, tank top type wet suit having upper and lower trunk portions 30 and 31 at the rear side of the suit. The upper trunk (vest) portion includes left and right sections 32 and 33 separated by a split, along which a diagonal zipper 34 extends. The split and zipper extend from the uppermost edge 35 of the upper trunk portion, below the wearer's neck 36, downwardly and sidewardly to terminate at a locus 33, offset toward the side 38 of the suit. Therefore, the entirety of the central back region 39 of the suit at the lower trunk portion, the waist region and the lower part of the upper trunk portion 30,are free to stretch unrestrictively during forward bending of the wearer's torso. Region 39 is defined between vertical lines 41 and 42, between which about 50% of the width of the back of the suit is defined. Shoulder straps appear at 46 and 47.

I claim:

1. In a wet suit having a lower trunk portion, leg portions integral with said lower truck portion, upper trunk and neck portions, and first and second arm portions integral with said upper truck and neck portions, the improvement comprising:

(a) said upper trunk and neck portions including a first section integral with the first arm portion and a second section integral with the second arm portion, the said sections defining a split that extends therebetween, downwardly and sidewardly to terminate at a locus in sidewardly offset relation to the center of the lower truck portion, said sections and split located at the rear side of the wet suit, having left and right waist zones, said locus being proximate one of said zones, the suit consisting of stretchable elastomeric sheet material, (b) and means on said sections to interconnect them along the length of the split, said means comprising zipper structure extending from proximate the top of said neck portion above the mid-region of the suit downwardly and diagonally to said locus, (c) the suit having inner and outer sides, said zipper structure located at the inner side of the suit, and including a protective diagonal flap at the inner side of the suit and overlapping said zipper structure at the inner side thereof, said flap carried by one of the sections.

2. The improvement of claim 1 wherein said lower truck portion at the rear side of the wet suit is continuous and everywhere spaced below said sections and said split.

* * * * *